US008196806B2

(12) United States Patent
Tao

(10) Patent No.: US 8,196,806 B2
(45) Date of Patent: Jun. 12, 2012

(54) FOLDABLE PACKING BOX

(76) Inventor: Jian Tao, Shen Zhen (CN)

( * ) Notice: Subject to any disclaimer, the term of this patent is extended or adjusted under 35 U.S.C. 154(b) by 457 days.

(21) Appl. No.: 12/484,237

(22) Filed: Jun. 14, 2009

(65) Prior Publication Data

US 2010/0314436 A1 Dec. 16, 2010

(51) Int. Cl.
*B65D 5/32* (2006.01)

(52) U.S. Cl. ..... 229/122.26; 229/122.32; 229/199

(58) Field of Classification Search ..... 229/122.24, 229/122.26, 122.32, 122.34, 172, 178, 199
See application file for complete search history.

(56) References Cited

U.S. PATENT DOCUMENTS

| | | | | | |
|---|---|---|---|---|---|
| 499,654 | A * | 6/1893 | Clark | 229/103.2 |
| 729,167 | A * | 5/1903 | Henderson | 229/152 |
| 770,915 | A * | 9/1904 | Maunsell-Smyth | 229/122.26 |
| 877,757 | A * | 1/1908 | Comings | 229/172 |
| 1,265,273 | A * | 5/1918 | Stokes et al. | 229/87.18 |
| 1,697,969 | A * | 1/1929 | Boeye | 229/122.26 |
| 2,119,058 | A * | 5/1938 | Richardson | 53/440 |
| 2,493,281 | A * | 1/1950 | Anderson, Jr. | 229/122.26 |
| 2,554,004 | A * | 5/1951 | Bergstein | 493/88 |
| 2,697,545 | A * | 12/1954 | Radin | 229/117.01 |
| 2,758,775 | A * | 8/1956 | Moore | 229/122.23 |
| 2,902,203 | A * | 9/1959 | Buttery | 229/172 |
| 3,099,379 | A * | 7/1963 | Stease | 229/122.26 |
| 3,311,285 | A * | 3/1967 | Korr | 229/145 |
| 3,363,824 | A * | 1/1968 | Murata | 206/511 |
| 3,469,765 | A * | 9/1969 | Mueller | 229/159 |
| 3,709,425 | A * | 1/1973 | Stapp | 229/122.22 |
| 3,863,831 | A * | 2/1975 | Wozniacki et al. | 229/120 |
| 4,347,968 | A * | 9/1982 | Cornell et al. | 229/167 |
| 4,380,314 | A * | 4/1983 | Langston et al. | 229/159 |
| 4,458,838 | A * | 7/1984 | Lacasa et al. | 229/151 |
| 5,390,847 | A * | 2/1995 | Young | 229/122.21 |
| 5,535,942 | A * | 7/1996 | Vilona | 229/199 |
| 6,029,885 | A * | 2/2000 | Mueller | 229/125.19 |
| 7,686,206 | B2 * | 3/2010 | Bondarik | 229/117.08 |
| 8,070,661 | B2 * | 12/2011 | Tao | 493/89 |
| 2004/0056081 | A1 * | 3/2004 | Christensen et al. | 229/122.26 |
| 2005/0279816 | A1 * | 12/2005 | Kao | 229/186 |
| 2007/0221716 | A1 * | 9/2007 | Tao | 229/141 |
| 2008/0314896 | A1 * | 12/2008 | Shellhorn et al. | 220/6 |

* cited by examiner

*Primary Examiner* — Gary Elkins
(74) *Attorney, Agent, or Firm* — Weiner & Burt, P.C.; Irving M. Weiner; Pamela S. Burt

(57) ABSTRACT

A foldable packing box of the present invention comprises a base board, a pair of side boards, and a pair of fixing boards. The base board includes a first end board, a bottom board connected to the first end board, and a second end board connected to the bottom board opposite to the first end board. The pair of side boards are respectively fixed to the opposite two sides of the bottom board. The fixing boards are respectively fixed to the sides of the first end board and the second end board apart from the bottom board. The base board, the side boards, and the fixing boards are foldable to locate at a same plane. While assembling the packing box, the side boards are fixed to the base board by the fixing boards. The foldable packing box of the present invention can locate in a plane to save the occupied space thereof during storage and transportation, so as to facilitate to reduce the storage and transportation cost. Furthermore, the foldable packing box of the present invention separately makes the base board, side boards, and fixing boards for make full use of the material thereby reducing the production cost.

3 Claims, 4 Drawing Sheets

FOLDABLE PACKING BOX

FIELD OF THE INVENTION

The present invention relates to a packing box, particularly relates to a foldable packing box.

BACKGROUND OF THE INVENTION

Packing boxes are often used to pack food, cosmetic, stationery and decoration. When a packing box is made, the packing box has a fixed volume. The packing box will occupy the same space whether the packing box receives goods or not. Therefore, the conventional packing box needs large space to store and transport, which increases cost of storage and transportation.

To solve the above mentioned problems of packing boxes, a foldable packing box has been designed. The conventional foldable packing box includes a plurality of foldable connecting boards. During transportation, the connecting boards are folded to locate at a same plane for saving space, so as to reduce transportation cost. However, while using a conventional foldable packing box, every connecting board should be connected with glue, which results in failing in reusing. Moreover, a conventional foldable packing box generally is made by cutting a whole piece of paper board and the finished product of the packing box as a whole is integrally made by one piece of paper board, which causes great waste of materials during making a conventional foldable packing box and adversely affects to save the production cost. Additionally, a conventional foldable packing box is usually made of a single layer paper board which has poor tactile sensation. The inner surface and the outer surface of the packing box are not ready for being patterned or colored. Therefore, it is not ready for producing a packing box with more aesthetic sensibility.

SUMMARY OF THE INVENTION

An object of the present invention is to provide a foldable packing box which is foldable repeatedly, thereby facilitating to reuse.

Another object of the present invention is to provide a foldable packing box of which a base board, a pair of side boards and a pair of fixing boards are made separately for making full use of the materials of paper board to avoid wasting, thereby efficiently reducing the cost.

A further object of the present invention is to provide a foldable packing box of which paper boards of a base board and a pair of side boards are made by pasting for readily providing patterns or colors to the inner and outer surface of the paper boards, so as to increase the aesthetic sensibility of the packing box.

To achieve the above mentioned objects, a foldable packing box of the present invention comprises: a base board, a pair of side boards, and a pair of fixing boards. The base board includes a first end board, a bottom board connected to the first end board, and a second end board connected to the bottom board opposite to the first end board. The pair of side boards are respectively fixed to the opposite two sides of the bottom board. The fixing boards are respectively fixed to the sides of the first end board and the second end board apart from the bottom board. The base board, the side boards, and the fixing boards are foldable to locate at a same plane. While assembling the packing box, the side boards are fixed to the base board by the fixing boards.

Wherein the base board comprises an outer layer paper, a plurality of core boards, and an inner layer paper; the plurality of core boards are in turn pasted to the outer layer paper, and a gap is located between adjacent core boards; the outer layer paper covers one surface of the plurality of core boards with edges thereof being folded to be pasted to the other surface of the core boards; the inner layer paper is pasted to the other surface of the core boards, and covers the edges of the outer layer paper.

Wherein the base board comprises five core boards; corresponding to the five core boards, the base board in turn forms a first end board, a bottom board, a second end board, a cover board, and a fastening board; the size of the first and the second end board is substantially the same, and the size of the bottom board and the cover board is substantially the same.

Wherein the fastening board is fastenable to the first end board, the fastening board and the first end board are separately correspondingly provided with magnets or Velcros, and the fastening board is fastened to the first end board by the magnets or Velcros.

Wherein the side board comprises a surface layer paper, three core boards, and a lining layer paper; the three core boards are in turn pasted to the surface layer paper, and a gap is defined between adjacent core boards.

Wherein corresponding to the three core boards, the side board respectively forms a base part, and two installation parts located at the opposite ends of the base part; the side board further comprises a fixing part located at one side of the base part; the fixing part is formed by the surface layer paper pasted to the lining layer paper; the fixing parts of the two side boards are separately fixed to the two sides of the bottom board of the base board.

Wherein the surface layer paper covers one surface of the three core boards with edges thereof without connection with the fixing part being folded to be pasted to the other surface of the core boards; the lining layer paper is pasted to the other surface of the core boards, and covers the edges of the surface layer paper; the fixing part of the side board is located between the outer layer paper and the inner layer paper of the bottom board of the base board.

Wherein the fixing board comprises a first abutting part, a second abutting part connected to the first abutting part, and a connecting part connected to the first abutting part opposite to the second abutting part; folding lines are separately formed between the first abutting part and the second abutting part, and between the first abutting part and the connecting part.

Wherein the length of the first abutting part is substantially the same as the distance between the base parts of the side boards fixed to the bottom board; the width of the first abutting part is configured to make the second abutting part abut against the inner surface of the bottom board.

Wherein the side board comprises a U-shaped surface paper, and three U-shaped core boards received in the U-shaped surface paper; the U-shaped core board is formed by folding a core board in two along an elongate groove defined in the outside of the folding position; therefore, after the core board is folded in two along the elongate groove, a plane is formed at the outer surface of the folding position.

The foldable packing box of the present invention can locate in a plane to save the occupied space thereof during storage and transportation, so as to facilitate to reduce the storage and transportation cost. The foldable packing box of the present invention can be folded at multiple times, which is ready for reusing. Furthermore, the foldable packing box of the present invention separately makes the base board, side boards, and fixing boards to avoid wasting the materials for integrally forming the base board, side boards and fixing boards, thereby reducing the production cost. Moreover, by providing the outer layer and inner layer paper, and the surface layer and lining layer paper to the packing box, the durability of the foldable packing box is increased, and it is convenient for providing patterns or colors to the packing box for increasing the aesthetic sensibility of the foldable packing box.

The characteristic and the technical solution of the present invention are best understood from the following detailed description with reference to the accompanying figures, but the figures are only for reference and explaining, not to limit the scope of the invention.

BRIEF DESCRIPTION OF THE DRAWINGS

The technical solution and the beneficial effects of the present invention are best understood from the following detailed description with reference to the accompanying figures and embodiments.

DESCRIPTION OF THE PREFERRED EMBODIMENTS

To further set forth the technical solution adopted by the present invention to achieve the predetermined objects and the effects, please read the following detailed description and figures according to the present invention; the objects, characteristics and novel features of the present invention will be best understood, but the figures are only for reference and explaining, not to limit the scope of the invention.

Figure 1:
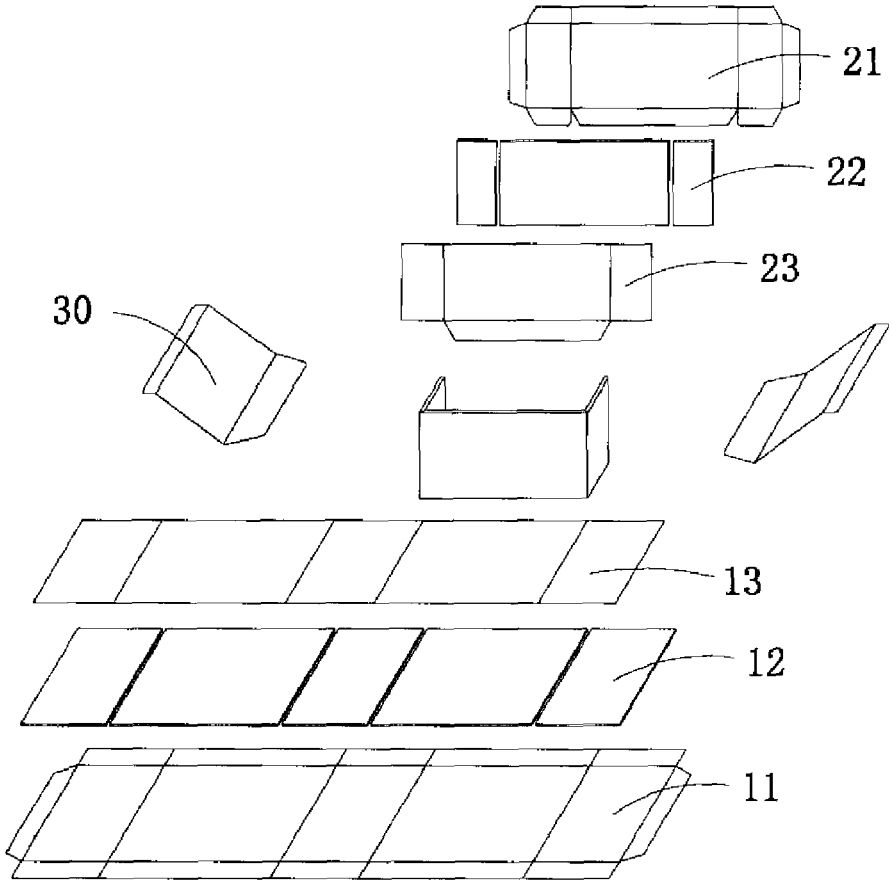
FIG. 1 is an exploded view of a foldable packing box in accordance with an embodiment of the present invention.
Figure 2:
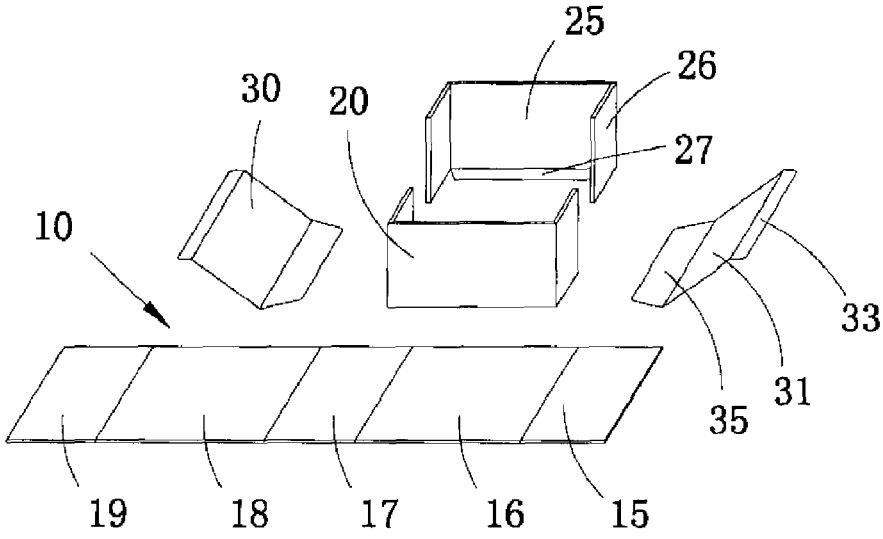
FIG. 2 is a partially assembled view of FIG. 1.
Figure 3:
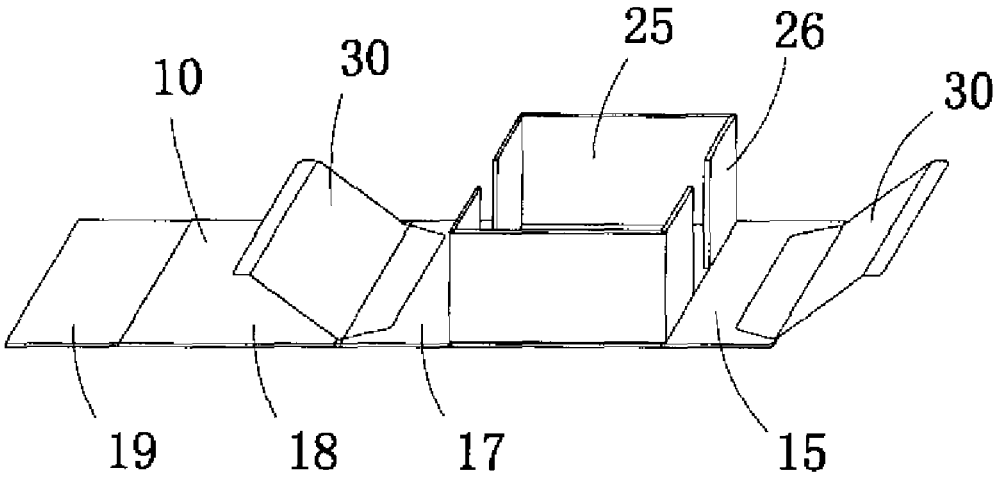
FIG. 3 is an assembled view of FIG. 1.

Referring to FIGS. 1-3, a foldable packing box in accordance with an embodiment of the present invention comprises a base board 10, a pair of side boards 20 fixed to the base board 10, and a pair of fixing boards 30 fixed to the base board 10. The base board 10, the side boards 20, and the fixing boards 30 are foldable to locate at a same plane for convenient transportation or storage. In assembly of the foldable packing box, the side boards 20 are fixed to the base board 10 via the fixing boards 30.

The base board 10 comprises an outer layer paper 11, a plurality of core boards 12, and an inner layer paper 13. The plurality of core boards 12 are in turn pasted to the outer layer paper 11. A gap (not shown) is defined between adjacent core boards 12 for facilitating to fold the base board 10. The outer layer paper 11 covers one surface of the plurality of core boards 12 with four edges thereof being folded to paste to the other surface of the core boards 12. The inner layer paper 13 is pasted to the other surface of the core boards 12, and covers the edges of the outer layer paper 11. In this embodiment, the base board 10 comprises five core boards 12. Corresponding to the five core boards 12, the base board 10 in turn forms a first end board 15, a bottom board 16, a second end board 17, a cover board 18, and a fastening board 19. The size of the first and the second end board 15, 17 is substantially the same, and the size of the bottom board 16 and the cover board 18 is substantially the same. The fastening board 19 can be fastened to the first end board 15. In this embodiment, the fastening board 19 and the first end board 15 are separately correspondingly provided with magnets or Velcros (not shown), and the fastening board 19 is fastened to the first end board 15 via the magnets or Velcros.

The side board 20 comprises a surface layer paper 21, three core boards 22, and a lining layer paper 23. The three core boards 22 are in turn pasted to the surface layer paper 21, and a gap (not shown) is defined between adjacent core boards 22 for readily folding the side board 20. Corresponding to the three core boards 22, the side board 20 separately forms a base part 25, and two installation parts 26 located at the opposite ends of the base part 25. The side board 20 further comprises a fixing part 27 located at one side of the base part 25. The fixing part 27 is formed by the surface layer paper 21 pasted to the lining layer paper 23. The surface layer paper 21 covers one surface of the three core boards 22, with there edges thereof without connection with the fixing part 27 are folded to be pasted to the other surface of the core boards 22. The lining layer paper 23 is pasted to the other surface of the core boards 22, and covers the three edges of the surface layer paper 21. The fixing parts 27 of the two side boards 20 are separately fixed to the two sides of the bottom board 16 of the base board 10. The length of the base part 25 is substantially the same as the width of the bottom board 16 of the base board 10. The width of the base part 25 is substantially the same as the width of the first and second end boards 15, 17.

In an alternative embodiment, the fixing part 27 of the side board can be located between the outer layer paper 11 and the inner layer paper 13 of the bottom board 16 of the base board 10 thereby pasting both sides of the fixing part 27 to base board 10 whereby the stability of the connection between the side board 20 and the base board 10 is increased. The aesthetic sensibility of the foldable packing box is increased since the fixing part 27 does not expose to the bottom board 16.

The fixing board 30 comprises a first abutting part 31, a second abutting part 33 connected to the first abutting part 31, and a connecting part 35 connected to the first abutting part 31 opposing to the second abutting part 33. Folding lines (not labeled) are separately formed between the first abutting part 31 and the second abutting part 33, and between the first abutting part 31 and the connecting part 35. The folding lines can be formed conventionally. The connecting parts 35 of the two fixing boards 30 are respectively connected to the sides of the first and second end board 15, 17 apart from the bottom board 16. The length of the first abutting part 31 is substantially the same as the distance between the base parts 25 of the side boards 20 fixed to the bottom board 16. The width of the first abutting part 31 is configured to makes the second abutting part 33 to abut against the inner surface of the bottom board 16 with slight interferential engagement.

Figure 4:
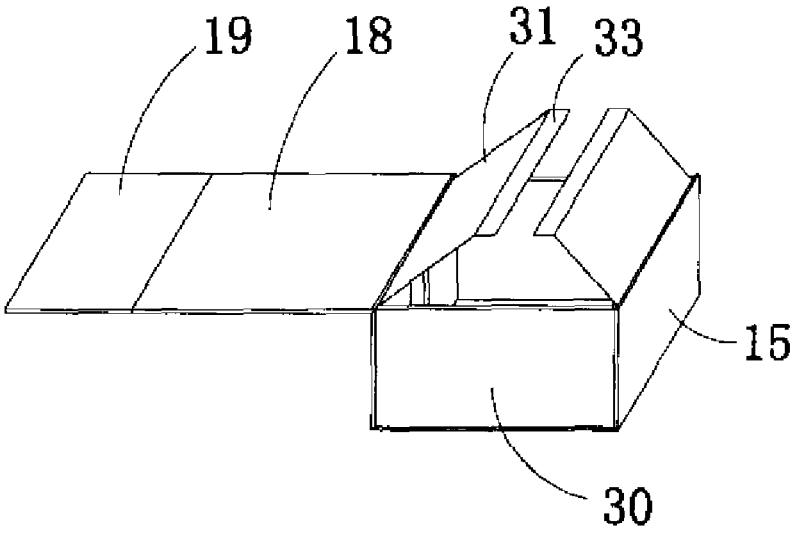
FIGS. 4-5 are schematic views showing different steps of assembling the foldable packing box of FIG. 3.
Figure 5:
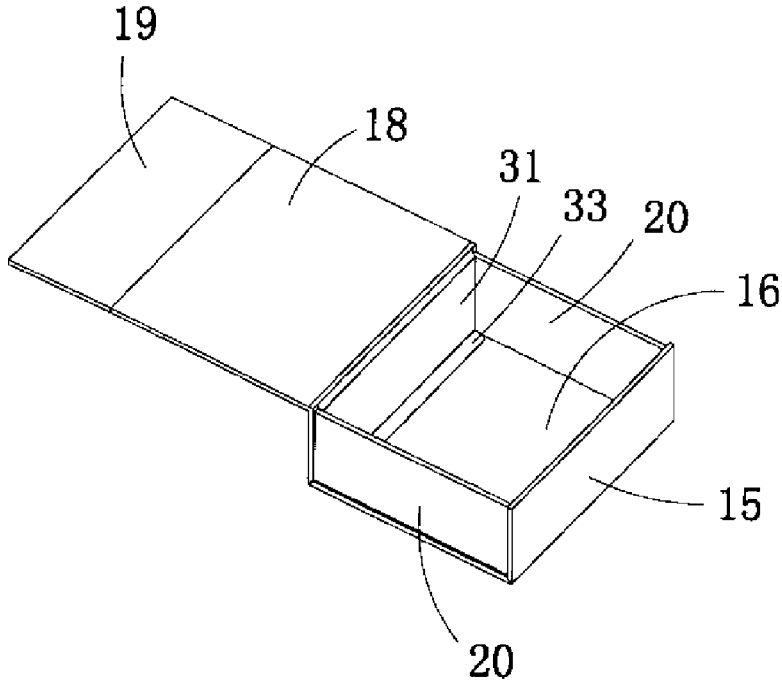

Referring to FIGS. 4-5, in assembly and use of the foldable packing box of the present invention, firstly the two side boards 20 are separately bent upwards, to make the base part 25 of the side board 20 to be vertical to the bottom board 16 of the base board 10. Then the four installation parts 26 are all bent inwards, to make the installation parts 26 to be vertical to both the base part 25 and the bottom board 16. Then the first and the second end boards 15, 17 are separately bent upwards, to separately close to the four installation parts 26. And then the fixing boards 30 are bent downwards and outwards separately, to make the first abutting parts 31 to separately abut against the inner surface of the four installation parts 26, and make the second abutting parts 33 to abut against the inner surface of the bottom board 16. Through the interferential engagement between the first abutting parts 31 and the base part 25 of the side board 20, and between the second abutting parts 33 and the bottom board 16, the first and the second end boards 15, 17 are separately fixed to the side boards 20, thereby forming a rectangular box. Therefore, in assembly and use of the foldable packing box of the present invention, it does not need to paste with glue or self-adhesive label. Thus, it is convenient, quick, and environmentally friendly to assemble and use the foldable packing box of the present invention, and it is convenient for reusing. Moreover, since the side boards 20 and the fixing boards 30 are separately formed and then assembled to the base board 10, it is ready to make full use of the materials and simplify the processing technique, thereby reducing the cost. Additionally, since the base board 10 and the side boards 20 adopt three-layer structure, it is ready to increase the durability of the packing box, and it is convenient for designing the appearance of the packing box and improving the aesthetic sensibility of the packing box, by providing corresponding patterns or colors to the outer layer paper and the surface layer paper, and by providing corresponding patterns or colors to the inner layer paper and the lining layer paper.

Figure 6:
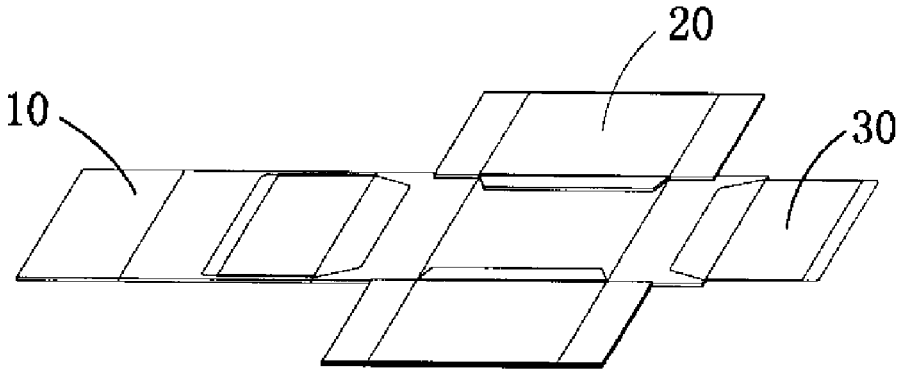
FIG. 6 is a schematic view showing the foldable packing box of FIG. 5 being unfolded to be in a plane.

Referring to FIG. 6, in transportation or storage of the foldable packing box of the present invention, the base board 10, side boards 20, and the fixing boards 30 are released to locate at a same plane, thus the volume of the product is greatly reduced for increasing the transportation or storage efficiency and preventing the packing box from being crushed or squashed.

Figure 7:
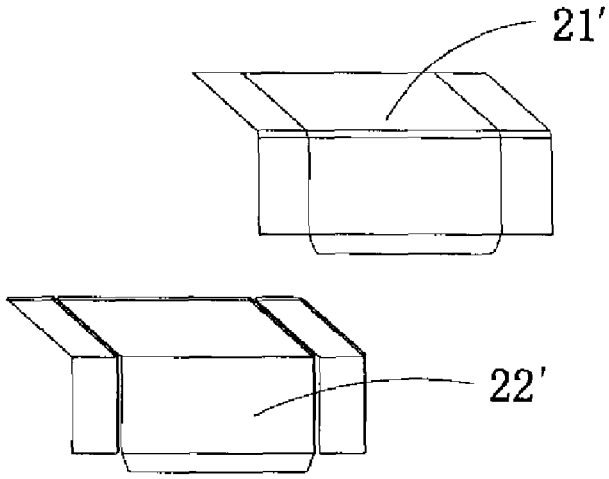
FIG. 7 is an exploded view of a side board of the foldable packing box in accordance with another embodiment of the present invention.
Figure 8:
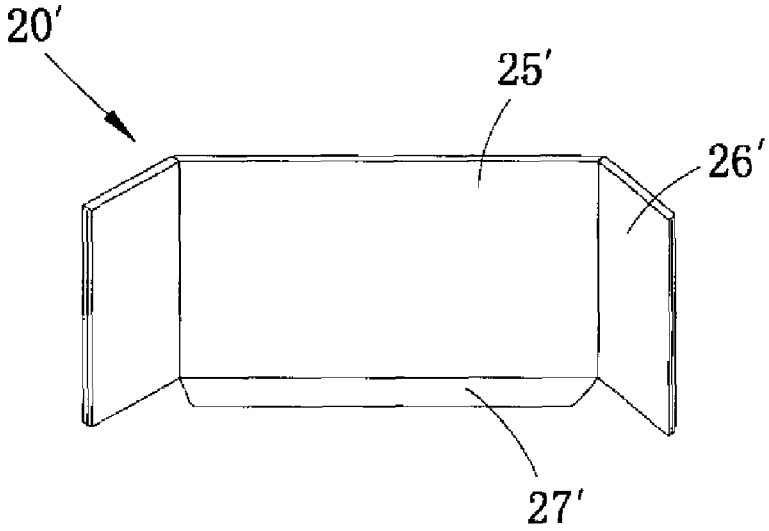
FIG. 8 is an assembled view of FIG. 7.

Referring to FIGS. 7-8, a side board 20' in accordance with an alternative embodiment of the present invention is shown. The side board 20' comprises a U-shaped surface paper 21', and three U-shaped core boards 22' received in the U-shaped surface paper 21'. The U-shaped core board 22' is formed by folding a core board in two along an elongate groove (not shown) defined in the outside of the folding position. Therefore, after the core boards 22' are folded in two along the elongate groove, a plane is formed at the outer surface of the folding position, and the folded core boards are glued together via glue. Gaps are defined between the three U-shaped core boards 22' to form the folding lines, whereby the side board 20' forms a base part 25', and two installation parts 26' located at the two ends of the base part. The side board 20' further comprises a fixing part 27' extending out from the surface paper 21' of the base part. The side board 20' in accordance with this embodiment of the present embodiment is formed with a simple manufacture technology, a low cost, and a better tactile sensation.

In summary, the foldable packing box of the present invention, can locate in a plane to save the occupied space thereof during storage and transportation, so as to facilitate to reduce the storage and transportation cost. The foldable packing box of the present invention can be folded at multiple times, which is ready for reusing. Furthermore, the foldable packing box of the present invention separately makes the base board, side boards, and fixing boards to avoid wasting the materials for integrally forming the base board, side boards and fixing boards, thereby reducing the production cost. Moreover, by providing the outer layer and inner layer paper, and the surface layer and lining layer paper to the packing box, the durability of the foldable packing box is increased, and it is convenient for providing patterns or colors to the packing box for increasing the aesthetic sensibility of the foldable packing box.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A foldable packing box comprising:

a base board including a first end board, a bottom board connected to the first end board, and a second end board connected to the bottom board opposite to the first end board;

a pair of side boards respectively fixed to opposite two sides of the bottom board of the base board; and a pair of fixing boards respectively fixed to sides of the first and second end boards apart from the bottom board; the base board, the side boards, and the fixing boards being foldable to locate at a same plane; while assembling the foldable packing box, the side boards being fixed to the base board by the fixing boards;

wherein the side board comprises a surface layer paper, three core boards, and a lining layer paper; the three core boards are in turn pasted to the surface layer paper, and a gap is defined between adjacent core boards;

wherein corresponding to the three core boards, each side board respectively forms a base part, and two installation parts located at the opposite ends of the base part; each side board further comprises a fixing part located at one side of the base part; the fixing part is formed by the surface layer paper pasted to the lining layer paper; the pair of side boards has two fixing parts which are separately fixed to the opposite two sides of the bottom board of the base board.

2. The foldable packing box of claim 1, wherein the base board comprises an outer layer paper, a plurality of core boards, and an inner layer paper; the plurality of core boards are in turn pasted to the outer layer paper, and a gap is located between adjacent core boards; the outer layer paper covers one surface of the plurality of core boards with edges thereof being folded to be pasted to the other surface of the core boards; the inner layer paper is pasted to the other surface of the core boards, and covers the edges of the outer layer paper.

3. The foldable packing box of claim 1, wherein the fixing board comprises a first abutting part, a second abutting part connected to the first abutting part, and a connecting part connected to the first abutting part opposite to the second abutting part; folding lines are separately formed between the first abutting part and the second abutting part, and between the first abutting part and the connecting part.

* * * * *